United States Patent [19]

Niizato et al.

[11] Patent Number: 5,007,392

[45] Date of Patent: Apr. 16, 1991

[54] CYLINDER HEAD STRUCTURE FOR MULTIPLE CYLINDER ENGINES

[75] Inventors: Tomonori Niizato; Katsumi Noguchi; Kiyoshi Tsukimura, all of Saitama, Japan

[73] Assignee: Honda Giken Kogyo Kabushiki Kaisha, Tokyo, Japan

[21] Appl. No.: 388,259

[22] Filed: Aug. 1, 1989

[30] Foreign Application Priority Data

Aug. 1, 1988 [JP] Japan ..... 63-192377

[51] Int. Cl.[5] ..... F02B 15/00

[52] U.S. Cl. ..... 123/193 H; 123/432; 123/308

[58] Field of Search ..... 123/193 H, 308, 432, 123/315

[56] References Cited

U.S. PATENT DOCUMENTS

| | | | |
|---|---|---|---|
| 4,538,547 | 9/1985 | Lombardi | 123/432 |
| 4,669,434 | 6/1987 | Okumura et al. | 123/432 |
| 4,671,228 | 6/1987 | Tomita et al. | 123/432 |
| 4,726,341 | 2/1988 | Muranaka et al. | 123/432 |
| 4,726,343 | 2/1988 | Kruger | 123/300 |

*Primary Examiner*—Andrew M. Dolinar
*Assistant Examiner*—M. Macy
*Attorney, Agent, or Firm*—Lyon & Lyon

[57] ABSTRACT

A cylinder head structure for a multiple cylinder engine, comprising, at least for each of its cylinders (1) located at either longitudinal end of its cylinder bank: a combustion chamber (13) defined by the cylinder and a piston received therein; an intake passage (18) communicated with an intake manifold (20) at its one end and with said combustion chamber at its other end; and exhaust passage (19) communicated with an exhaust manifold (21) at its one end and with said combustion chamber at its other end; at least one of said intake passage and said exhaust passage being curved toward a longitudinally central part of said cylinder bank as it extends from its other end to its one end. Hence, the size and weight of the intake manifold and/or the exhaust manifold can be reduced. In particular, if the passage is communicated with the combustion chamber by a pair of ports (14*a*, 14*b*, 15*a*, 15*b*, 14*a'*, 14*b'*, 15*a'*, 15*b'*, 58*Ea*, 58*Eb*, 58*Ia*, 58*Ib*, 114*a'*, 114*b'*, 115*a'*, 115*b'*) controlled by valves and arranged along a longitudinal direction of the cylinder bank and different flow rates are assigned to these ports depending the operating conditions of the engine, a significant improvement in the performance of the engine may be attained by symmetrically arranging these ports with respect to a longitudinal center of the cylinder bank.

8 Claims, 9 Drawing Sheets

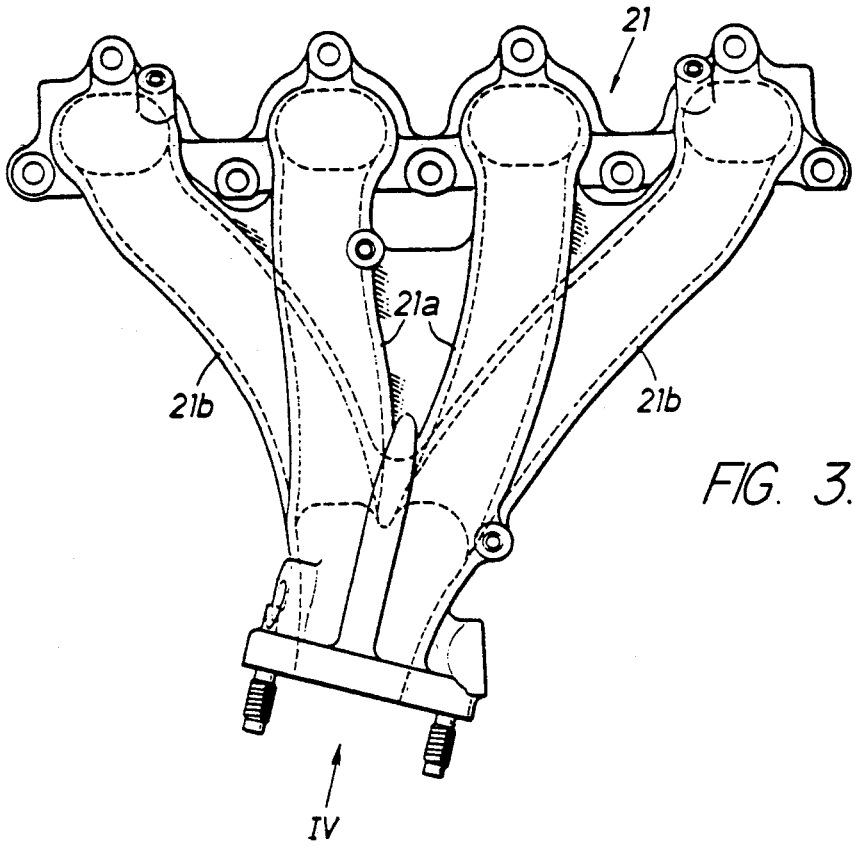
FIG. 3.
FIG. 4.
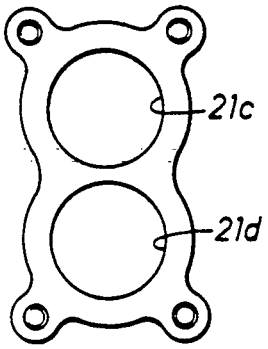
FIG. 5.
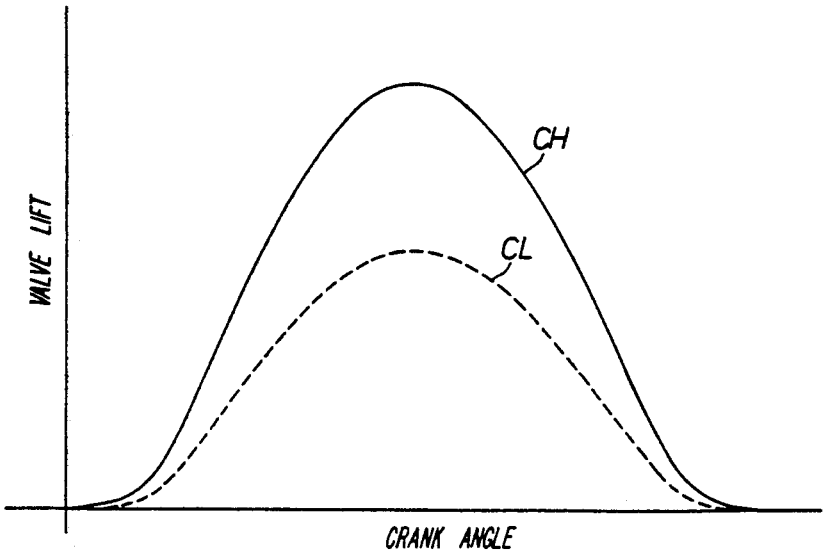

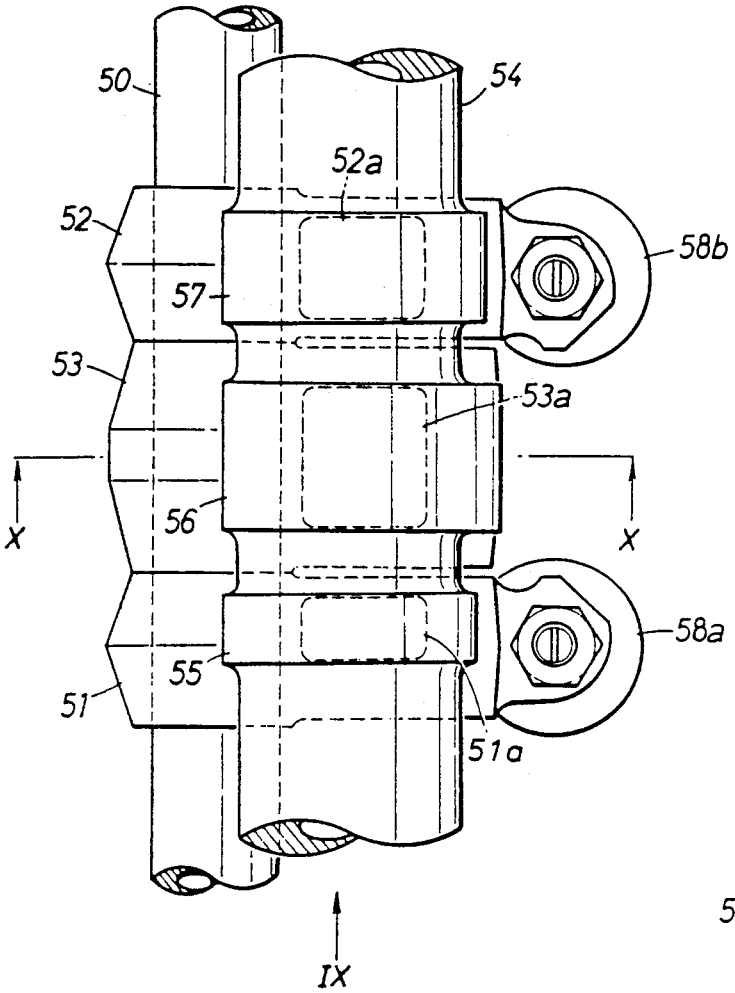
FIG. 8.
FIG. 10.
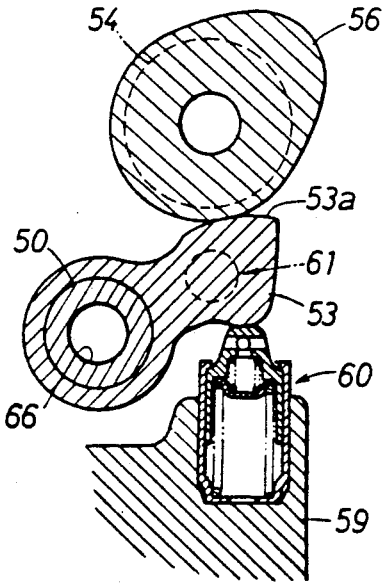
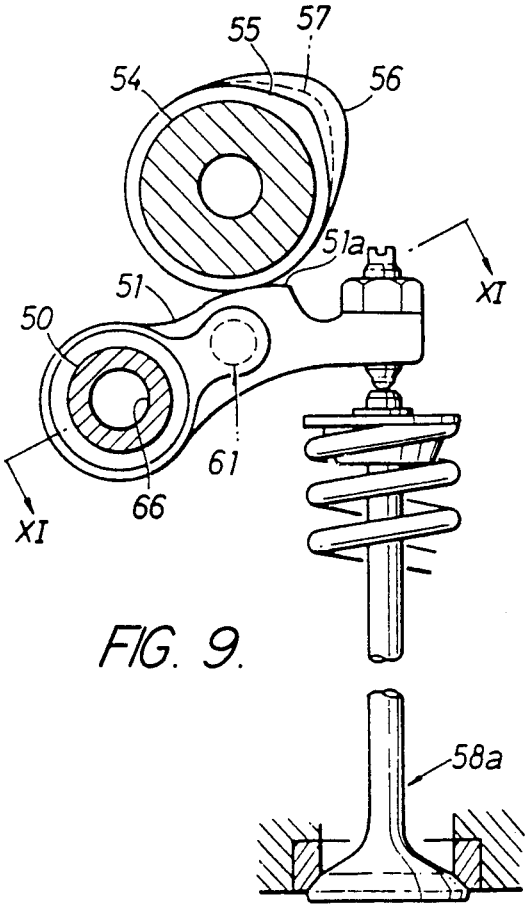
FIG. 9.

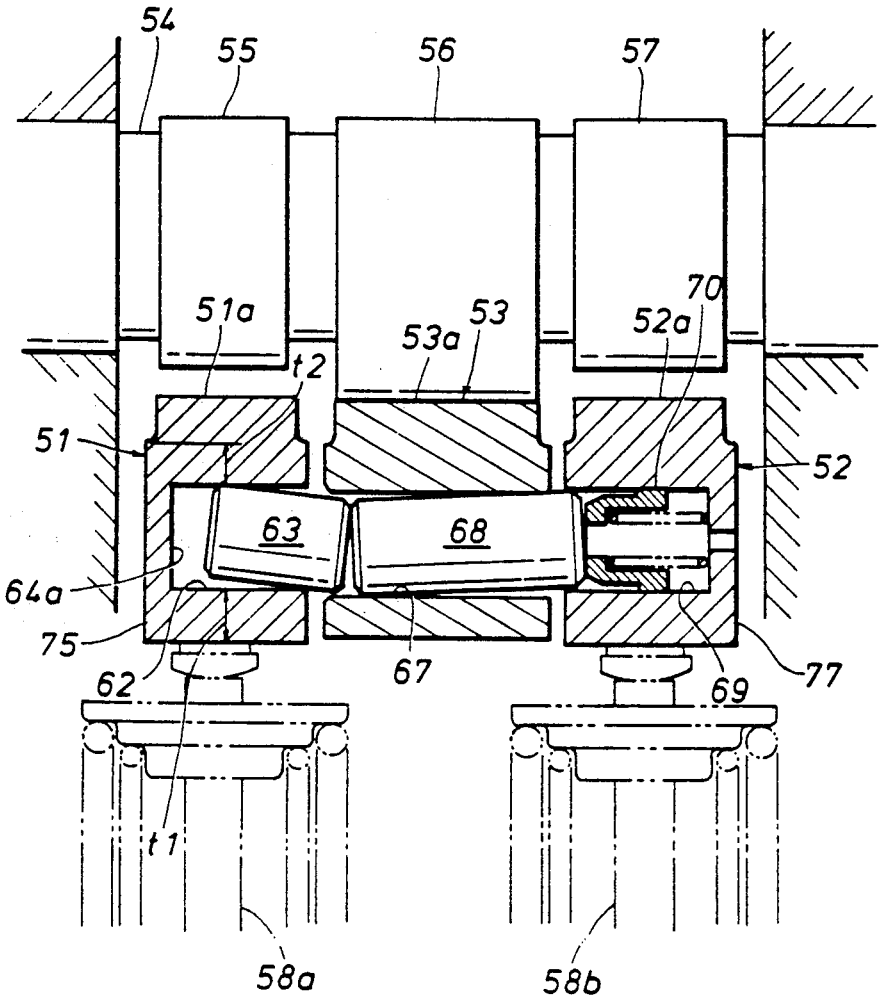
FIG. 15.
FIG. 16.
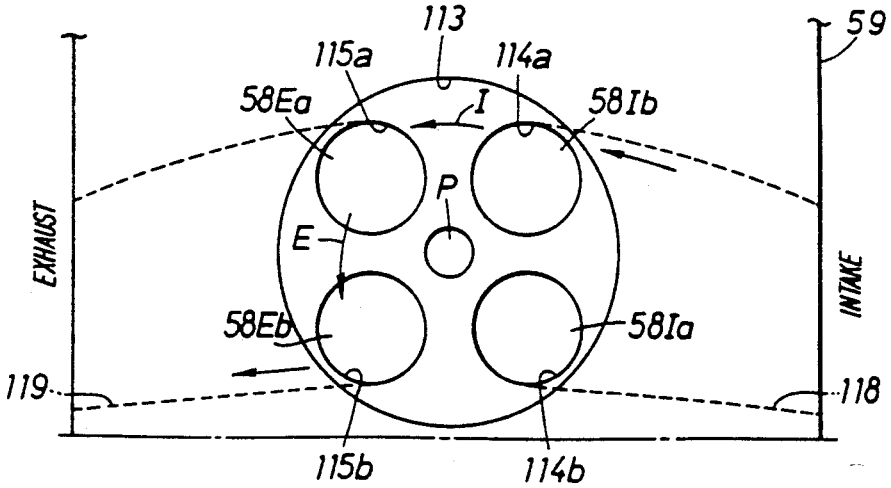

CYLINDER HEAD STRUCTURE FOR MULTIPLE CYLINDER ENGINES

TECHNICAL FIELD

The present invention relates to a cylinder head structure for multiple cylinder engines which allows more compact design of an engine than was possible heretofore, and in particular to such a cylinder head structure which can be advantageously used in combination with an engine using a plurality of intake and/or exhaust valves having different flow rate properties for each cylinder.

BACKGROUND OF THE INVENTION

As it is preferred to increase the cross sectional area of the passage leading to a combustion chamber in order to improve the volumetric efficiency of the engine, it has become increasingly common to provide a plurality of intake valves and/or exhaust valves for each cylinder with the aim of maximizing the effective area of the valves in relation with the internal surface area of the combustion chamber.

Also is known the valve control technology known as combination valve timing according to which a swirl is produced in the mixture introduced into the combustion chamber by shifting the opening and closing timing of the plural valves (Japanese patent laid-open publication No. 59-147822).

The temperature of combustion gas is extremely high and its flow speed may reach the sonic speed. It is therefore desirable to minimize the flow resistance of the exhaust passages to improve exhaust efficiency by taking advantage of the flow speed of exhaust gas.

The exhaust manifold which merges the exhaust passages leading to the exhaust ports opening out into the cylinder head is generally made of cast iron because of the heat resisting property of the material, and the exhaust manifold is desired to be made as small as possible to make room for mounting accessory equipment and to reduce the overall weight of the engine. A similar consideration applies also to the intake system of the engine.

BRIEF SUMMARY OF THE INVENTION

Based upon such considerations, a primary object of the present invention is to provide a cylinder head structure for multiple cylinder engines which can substantially reduce the size and weight of its intake and/or exhaust manifold.

A second object of the present invention is to provide a cylinder head structure which can improve the volumetric efficiency of the engine.

These and other objects of the present invention can be accomplished by providing a cylinder head structure for a multiple cylinder engine, comprising, at least for each of its cylinders located at either longitudinal end of its cylinder bank: a combustion chamber defined by the cylinder and a piston received therein; an intake passage communicated with an intake manifold at its one end and with the combustion chamber at its other end; and an exhaust passage communicated with an exhaust manifold at its one end and with the combustion chamber at its other end; at least one of the intake passage and the exhaust passage being curved toward a longitudinally central part of the cylinder bank as it extends from its other end to its one end, the curved passage being communicated with the combustion chamber at its other end by at least two ports which are controlled by valves and arranged along a longitudinal direction of the cylinder bank, and one of the ports involving a relatively larger flow rate being disposed closer to a longitudinally central part of the cylinder bank than the other port involving a relatively smaller flow rate.

Thus, the mounting surface of the intake and/or exhaust manifold for mounting it on a cylinder head can be reduced in the dimension along the longitudinal direction of the cylinder bank, and the overall size and weight of the engine can be reduced. Additionally, as the intake and/or exhaust passage can be made shorter and smoother, the performance of the engine can be also improved. Further, as the part of the flow passage directed to the port for a larger flow rate is shorter and more linear than that for the other port for a smaller flow rate, an overall improvement in volumetric efficiency can be achieved. Additionally, by appropriately selecting the configuration of the overall intake and exhaust system, a favorable swirl effect may be obtained and a favorable mixing of fuel with air can be achieved.

According to a preferred embodiment of the present invention, the curved passage consists of an exhaust passage, and an intake passage is communicated with the combustion chamber by at least two ports which are controlled by intake valves and arranged along a longitudinal direction of the cylinder bank, one of the intake ports involving a relatively smaller flow rate being disposed closer to a longitudinally central part of the cylinder bank than the other intake port involving a relatively larger flow rate. According to this embodiment, a favorable scavenging effect can be obtained in addition to a favorable volumetric efficiency.

According to a particularly preferred embodiment of the present invention, the exhaust and intake valves are controlled by a valve actuating mechanism in such a manner that all the valves are fully opened in high speed range, and one of the intake valves remote from a longitudinally central part of the cylinder bank and one of the exhaust valves close to a longitudinally central part of the cylinder bank are opened to intermediate extents while the other intake valve and the other exhaust valve are opened to small extents in low speed range. According to this embodiment, a favorable swirl effect can be produced in the flow of air/fuel mixture, and a favorable volumetric efficiency can be achieved.

Alternatively, one of the intake ports involving a relatively larger flow rate may be disposed closer to a longitudinally central part of the cylinder bank than the other intake port involving a relatively smaller flow rate so that a favorable volumetric efficiency may be obtained.

BRIEF DESCRIPTION OF THE DRAWINGS

Now the present invention is described in the following with reference to the appended drawings, in which:

FIG. 3 is a front view of an example of an exhaust manifold;

FIG. 4 is a view as seen from arrow IV of FIG. 3;

FIG. 5 is a graph showing valve lift curves;

FIG. 8 is a fragmentary plan view of a valve actuation mechanism;

FIG. 9 is a sectional view as seen from arrow IX of FIG. 8;

FIG. 10 is a sectional view taken along line X—X of FIG. 8;

FIG. 15 is a schematic sectional view of the valve actuating mechanism in exaggerated form.

FIG. 16 is a fragmentary schematic bottom view of a third embodiment of the cylinder head according to the present invention.

DETAILED DESCRIPTION OF THE PREFERRED EMBODIMENTS

Figure 1:
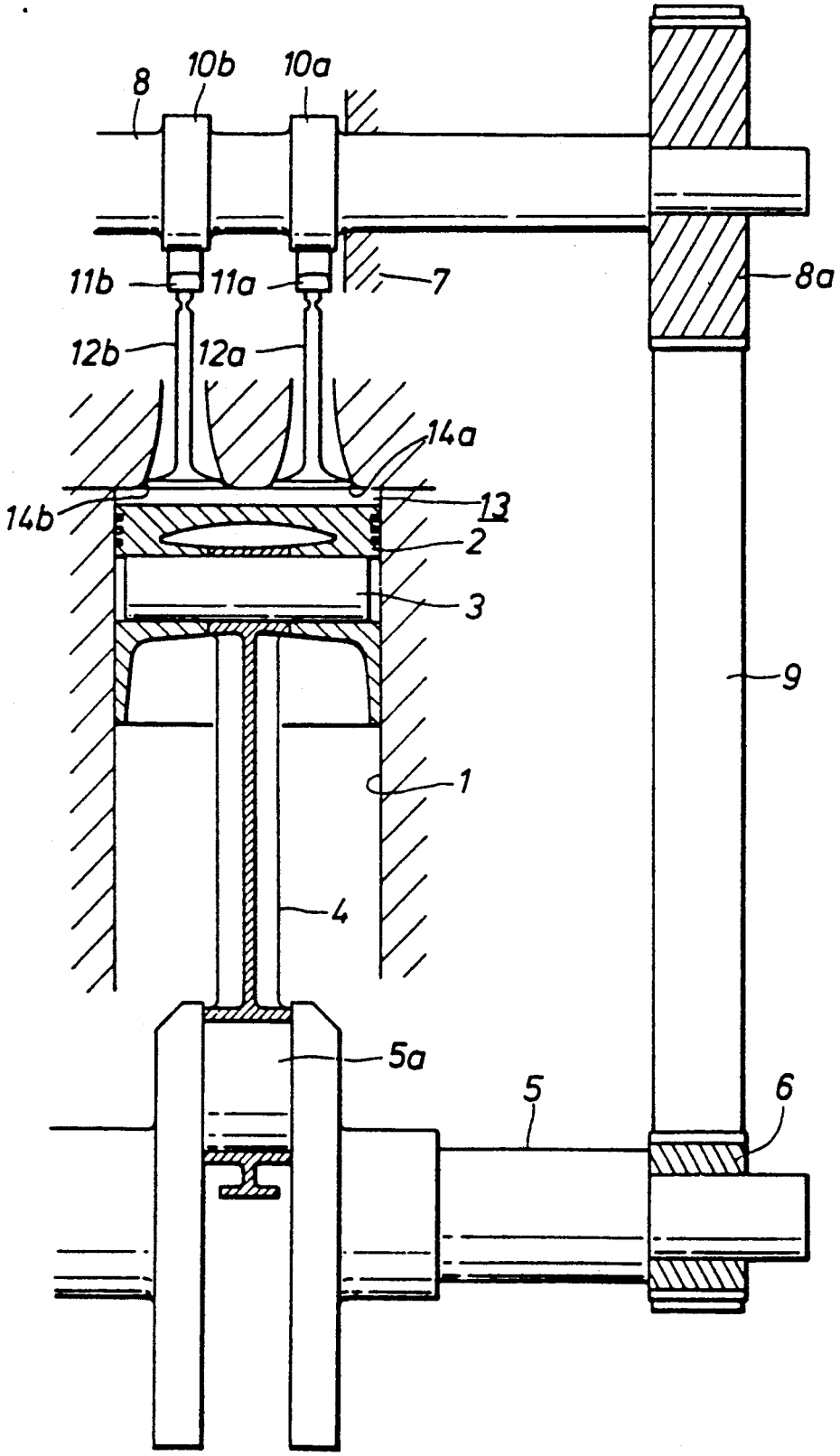
FIG. 1 is a schematic view of a part of an engine relevant to the present invention.

FIG. 1 shows a four-stroke multiple cylinder engine to which the present invention is applied. The piston 2 slidably received in each cylinder 1 is coupled with a small end of a connecting rod 4 via a piston pin 3, and a big end of the connecting rod 4 is coupled with a crank pin 5*a* of a crankshaft 5.

The rotation of the crankshaft 5 is transmitted to a camshaft 8 at a speed reduction factor of ½ via a timing belt 9 passed around a crank pulley 6 fixedly attached to an end of the crankshaft 5 and a cam pulley 8*a* fixedly attached to an end of the camshaft 8 supported by a cylinder head 7. The intake and exhaust valves are substantially identical to one another and are arranged in symmetrical fashion. As the intake valves and the exhaust valves are arranged symmetric to the central longitudinal line of the cylinder bank, either the intake valves or the exhaust valves are referred to in some of the following description without specifying which of them are referred to.

The camshaft 8 is provided with a pair of cams 10*a* and 10*b* for each cylinder 1, and these cams actuate two valves 12*a* and 12*b* via rocker arms 11*a* and 11*b* in reciprocating fashion so as to open and close intake ports 14*a* and 14*b* or exhaust ports 15*a* and 15*b*, as the case may be, opening into a combustion chamber 13 according to the various stroke processes of the internal combustion engine carried out in the combustion chamber 13.

Figure 2:
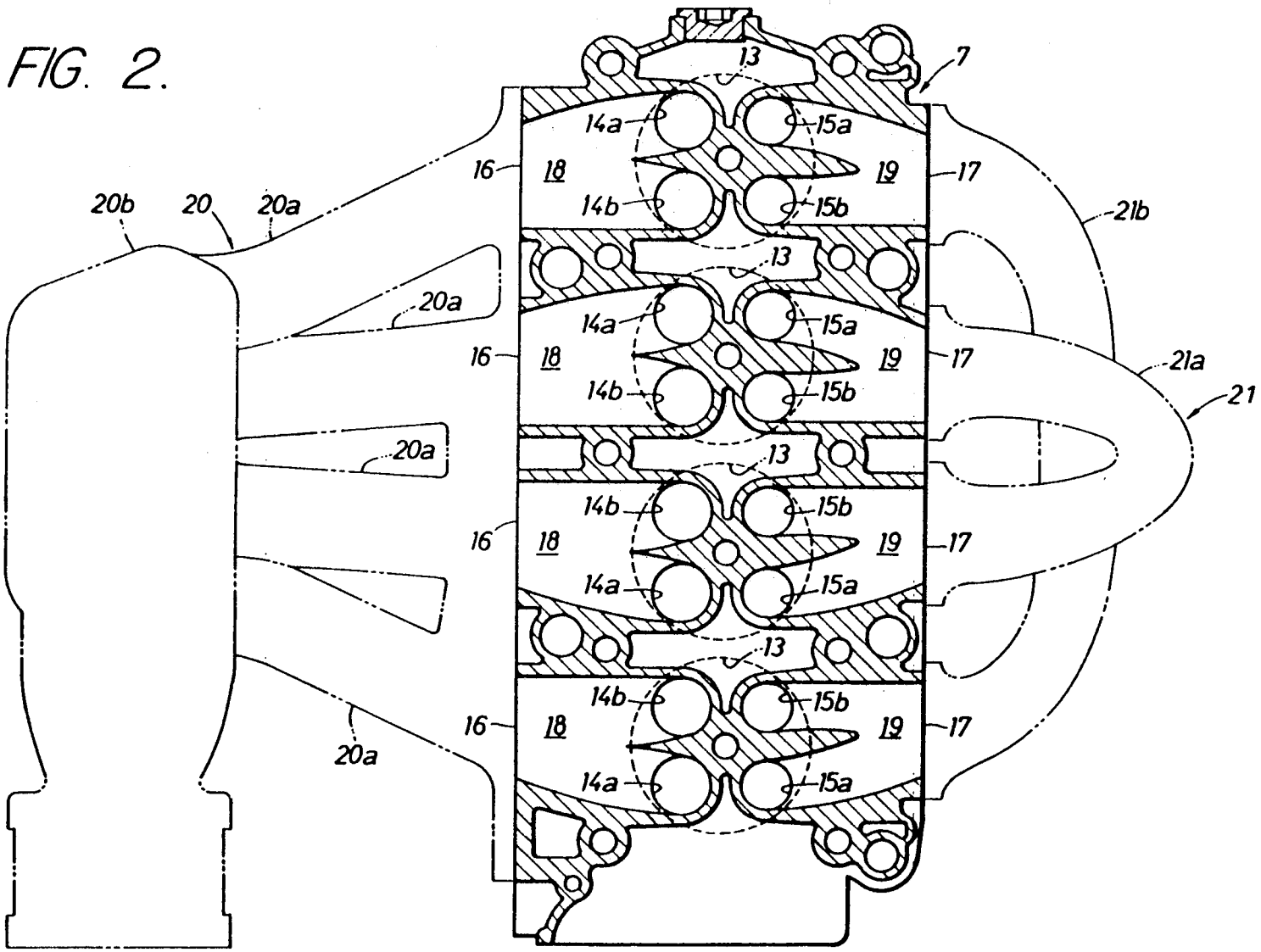
FIG. 2 is a horizontal sectional view of a cylinder head according to the present invention.

As shown in FIG. 2, the cylinder head 7 according to the present invention is provided, for each of its combustion chambers 13, with a pair of intake ports 14*a* and 14*b* and a pair of exhaust ports 15*a* and 15*b* which are closed and opened by a pair of intake valves and a pair of exhaust valves. These ports 14*a*, 14*b*, 15*a* and 15*b* are communicated with intake openings 16 and exhaust openings 17 which are provided on either side end of the cylinder head 7, via intake passages 18 and exhaust passages 19 provided in the cylinder head 7.

The intake openings 16 and the exhaust openings 17 are shifted towards a longitudinally central part of the cylinder bank in relation with the positions of the corresponding combustion chambers, and, accordingly, the intake passages 18 and the exhaust passages 19 are slightly curved towards the center as they move away from the corresponding combustion chambers 13. Each of the intake passages 18 diverges into two parts which lead to the intake ports 14*a* and 14*b* at a point immediately upstream of the intake ports 14*a* and 14*b*, and each of the exhaust passages 19 converges from two parts leading to the exhaust ports 15*a* and 15*b* into one at a point immediately downstream of the exhaust ports 15*a* and 15*b*. An intake manifold 20 and an exhaust manifold 21 are securely attached to the corresponding side ends of the cylinder head 7 at which the intake openings 16 and the exhaust openings 17 open up.

The intake manifold 20 comprises intake tubes 20*a* which are individually communicated with the corresponding intake openings 16, and an intake chamber 20*b* with which the intake passages 20*a* are commonly communicated at their upstream ends. As shown in FIG. 3, in the exhaust manifold 21, the exhaust tubes 21*a* connected to the two centrally located exhaust openings 19 are joined at a longitudinally central part of the cylinder bank, and the exhaust passages 21*b* communicated with the longitudinally externally located exhaust openings 19 are also joined at a central part. As shown in FIG. 4, these two merging parts 21*c* and 21*d* are aligned along a plane perpendicular to the longitudinal direction of the cylinder bank.

Since the intake manifold and the exhaust manifold of an in-line multiple cylinder engine are typically merged in a central part with respect to the longitudinal direction of the cylinder bank, by shifting the intake openings 16 and the exhaust openings 17 towards a central part with respect to the longitudinal direction of the cylinder bank, instead of simply extending intake and exhaust passages laterally from the combustion chambers 13, the dimensions of the intake manifold 20 and the exhaust manifold 21 can be reduced significantly.

The two valves 12*a* and 12*b* are opened and closed according to different valve lift curves as shown in FIG. 5; the valve 12*b* closer to the longitudinally central part of the cylinder bank is driven according to a lift curve CH which opens the valve over a relative large crank angle and by a relatively large valve lift while the external valve 12*a* is driven according to another lift curve CL which opens the valve over a relative small crank angle and by a relatively small valve lift.

Since the intake passages 18 and the exhaust passages 19 are curved toward the longitudinally central part of the cylinder bank as they move away from the combustion chambers 13, the parts of the intake passages 18 and the exhaust passages 19 located closer to the longitudinally central part of the cylinder bank are relatively short and linear as compared with the parts of the intake passages 18 and the exhaust passages 19 located remote from the longitudinally central part of the cylinder bank, and therefore involve relatively small flow resistance. Thus, by arranging the high-flow rate and high-lift intake or exhaust valves 12*b* in the parts of the flow passages 18 or 19 involving relatively small flow resistance, an improvement in overall volumetric efficiency can be achieved. At the same time, since a considerable difference in flow speed can be achieved between the two intake ports 14*a* and 14*b*, the resulting uneveness in the flow speed of the mixture in the combustion chamber 13 contributes to more favorable dispersion of the mixture and improvement of combustion efficiency.

Figure 6:
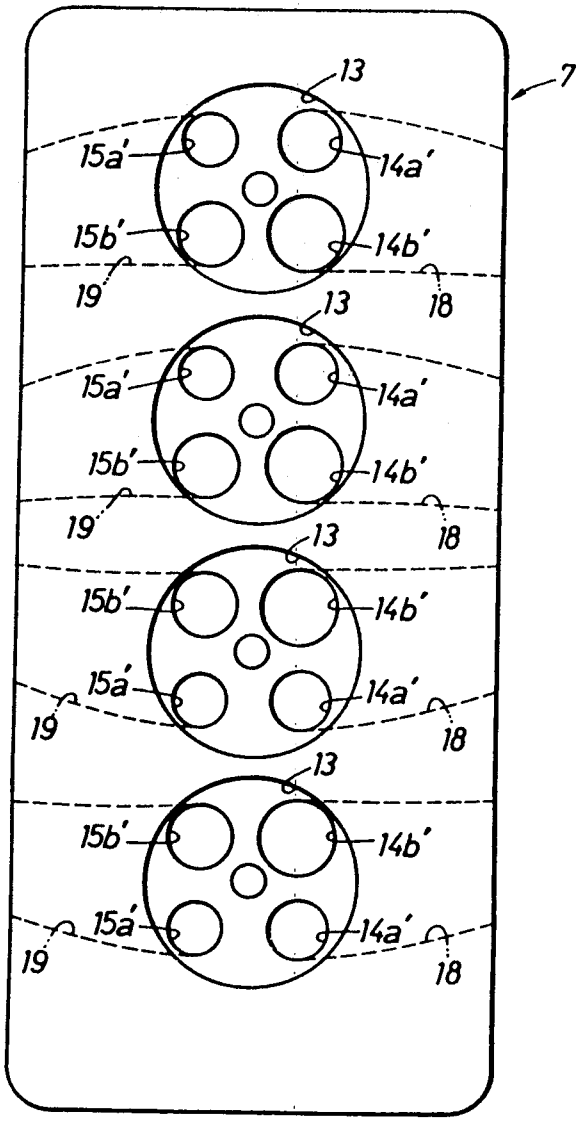
FIG. 6 is a schematic bottom view of a modified embodiment of the cylinder head according to the present invention.

In the above described embodiment, a plurality (two in the present case) of intake and exhaust valves are provided for each cylinder and a difference is thereby created in the flow rates of mixture or exhaust gas in these ports 14*a*, 14*b*, 15*a* and 15*b*, but it is also possible to create such a difference by making those ports 14*b'* and/or 15*b'* located closer to the longitudinally central part of the cylinder bank larger than those ports 14*a'* and/or 15*a'* located more remote from the longitudinally central part of the cylinder bank, as shown in FIG. 6. Further, it is also possible to combine the effects of the differences in the crank angle range for opening the valves, the lifts of the valves, and the opening areas of the ports.

Figure 7:
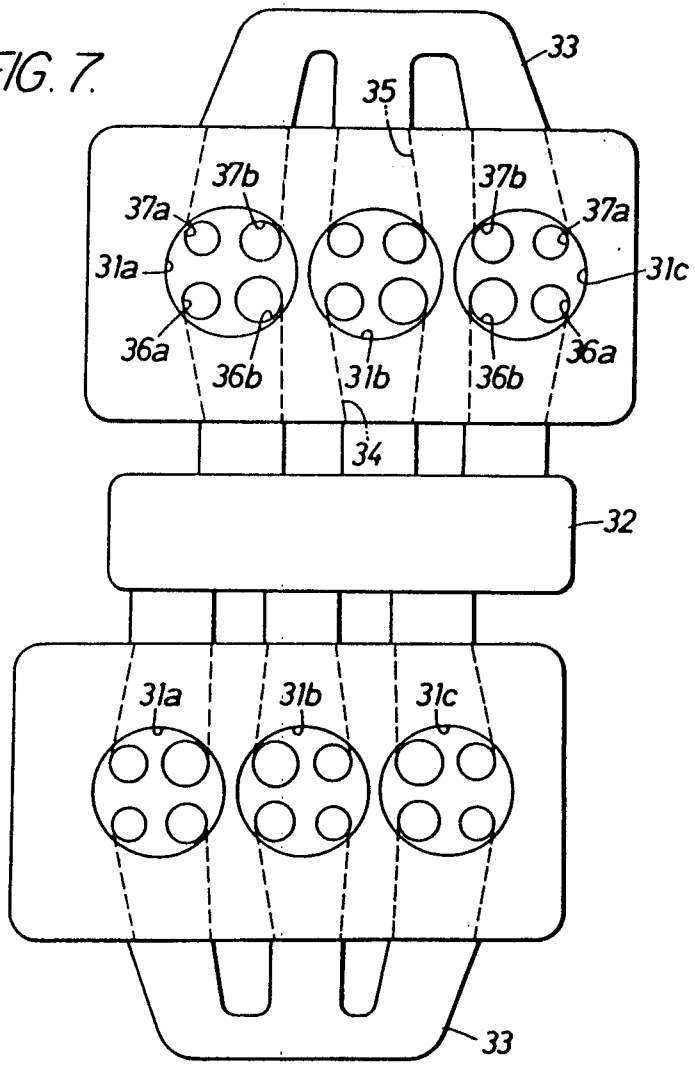
FIG. 7 is a schematic plan view of a second embodiment of the cylinder head according to the present invention.

FIG. 7 shows a second embodiment of the present invention which is applied to a V-type six-cylinder engine. In such a case where each cylinder bank of a V-type engine consists of an odd number of cylinders or in case where the engine consists of an in-line engine having an odd number of cylinders such as an in-line three or five cylinder engine, since centrally located combustion chambers 31*b* squarely face the merging parts of the intake manifolds 32 and the exhaust manifolds 3, the passages 34 and 35 leading thereto are naturally linear. Therefore, the above discussed inventive concept of the present invention may be applied to the externally located combustion chambers 31*a* and 31*c*. In other words, for each cylinder bank, ports 36*a* and 37*a* of relatively small flow rates may be arranged in external parts of the combustion chamber 31*a* and 31*c* with respect to the longitudinal line of the cylinder bank while ports 36*b* and 37*b* of relatively large flow rates may be arranged in relatively central parts along the longitudinal line of the cylinder bank.

Now, a third embodiment of the present invention is described in the following with reference to FIGS. 8 through 16.

The engine of the present embodiment also consists of a DOHC type in-line four-cylinder engine in which intake valves and exhaust valves are driven by separate camshafts and two intake valves and two exhaust valves are provided for each cylinder as was the case in the first and the second embodiments. These two kinds of valves are driven according to different timing schedule, but as they have basically identical structures, the structure of the valve actuating system is described in the following without specifying the kind of the valves.

As shown in FIGS. 8 through 11, the rocker shaft 50 fixedly secured to a cylinder head 59 pivotally supports three rocker arms 51, 52 and 53 in individually rotatable manner one next to the other for each cylinder. A camshaft 54 is supported above these rocker arms 51, 52 and 53 by way of camshaft bearings provided in the cylinder head 59. The camshaft 54 is provided with a first low-speed cam 55 involving a relatively small crank angle range for opening the valve and a relatively small valve lift, a high-speed cam 56 involving a relatively large crank angle range for opening the valve and a relatively large valve lift, and a second low-speed cam 57 involving an intermediate crank angle range for opening the valve and an intermediate valve lift. To the free ends of the first rocker arm 51, cooperating with the first low-speed cam 55, and the second rocker arm 52, cooperating with the second low-speed cam 57, abut the upper stem ends of a pair of valves 58*a* and 58*b*, respectively, which are normally urged in valve closing direction by coil springs (refer to FIG. 9). Meanwhile, the third rocker arm 53 which is located between the first and the second rocker arms 51 and 52 and cooperate with the high-speed cam 56 is normally urged upward by a lifter 60 provided in a part the cylinder head 59 corresponding to the third rocker arm 53 (refer to FIG. 10).

Figure 11:
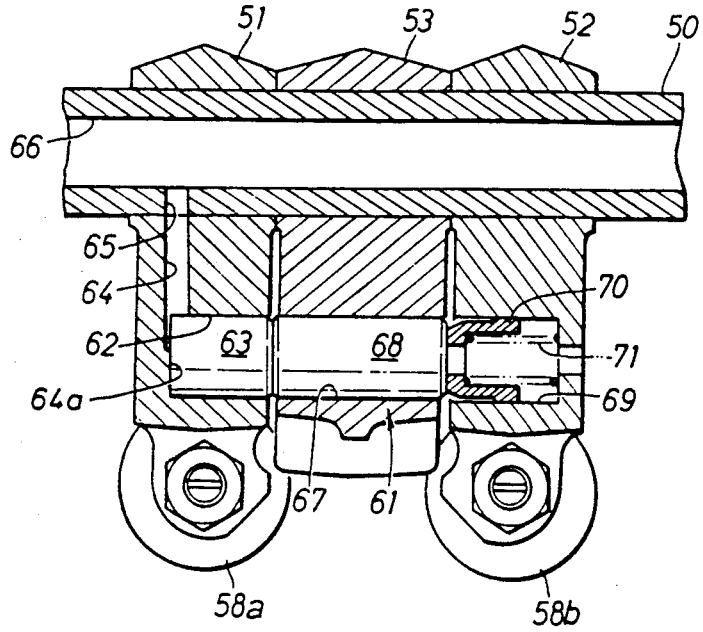
FIG. 11 is a sectional view taken along line XI—XI of FIG. 9.

The mutually adjoining first through third rocker arms 51 through 53 are internally provided with a coupling control device 61 (refer to FIG. 11). This coupling control device 61 comprises lateral guide bores provided in the rocker arms 51, 52 and 53, and coupling pins are slidably received in these guide bores.

The first rocker arm 51 is provided with a first guide bore 62 which opens out towards the third rocker arm 53 at its one end and is closed at its other end, and a first coupling pin 63 is slidably received in the first guide bore 62. The closed bottom end of the first guide bore 62 defining a chamber 64*a* is communicated with an oil passage 66 provided in the rocker shaft 50 via an oil passage 64 formed in the first rocker arm 51 and an oil supply port 65 provided in the rocker shaft 50.

The third rocker arm 53 is provided with a second guide bore 67 which is of the same diameter as the first guide bore 62 and is positioned coaxially with the first guide bore 62 when its cam slipper 53*a* is in contact with a base circle part of the high-speed cam 56, and these guide bores extend in parallel with the rocker shaft 50. A second coupling pin 68 is slidably received in the second guide bore 69 so as to abut the first coupling pin 63.

The second rocker arm 52 is likewise provided with a third guide bore 69 having a closed end, and receiving therein a stopper pin 70 which abuts the other end of the second coupling pin 68 at its one end. The stopper pin 70 is cylindrical in shape and partly closed at its one end, and is normally urged toward the third rocker arm 53 under the spring force of a return spring 71 interposed between its inner bottom surface and the bottom surface of the third guide bore 69.

In the state shown in FIG. 11, since the first coupling pin 63, the second coupling pin 68 and the stopper pin 70 are received in the corresponding guide bores 62, 67 and 69 under the spring force of the return spring 71, the rocker arms 51, 52 and 53 can move individually. By displacing the first and second coupling pins 63 and 68 laterally to the right in the sense of FIG. 11 by the action of the oil pressure introduced to the chamber 64*a* defined by the left end of the first coupling pin 63 via the oil passage 64 against the elastic force of the return spring 71, the rocker arms 51, 52 and 53 are integrally coupled with one another by the coupling pins 63 and 68 being positioned across the adjacent guide bores.

Figure 12:
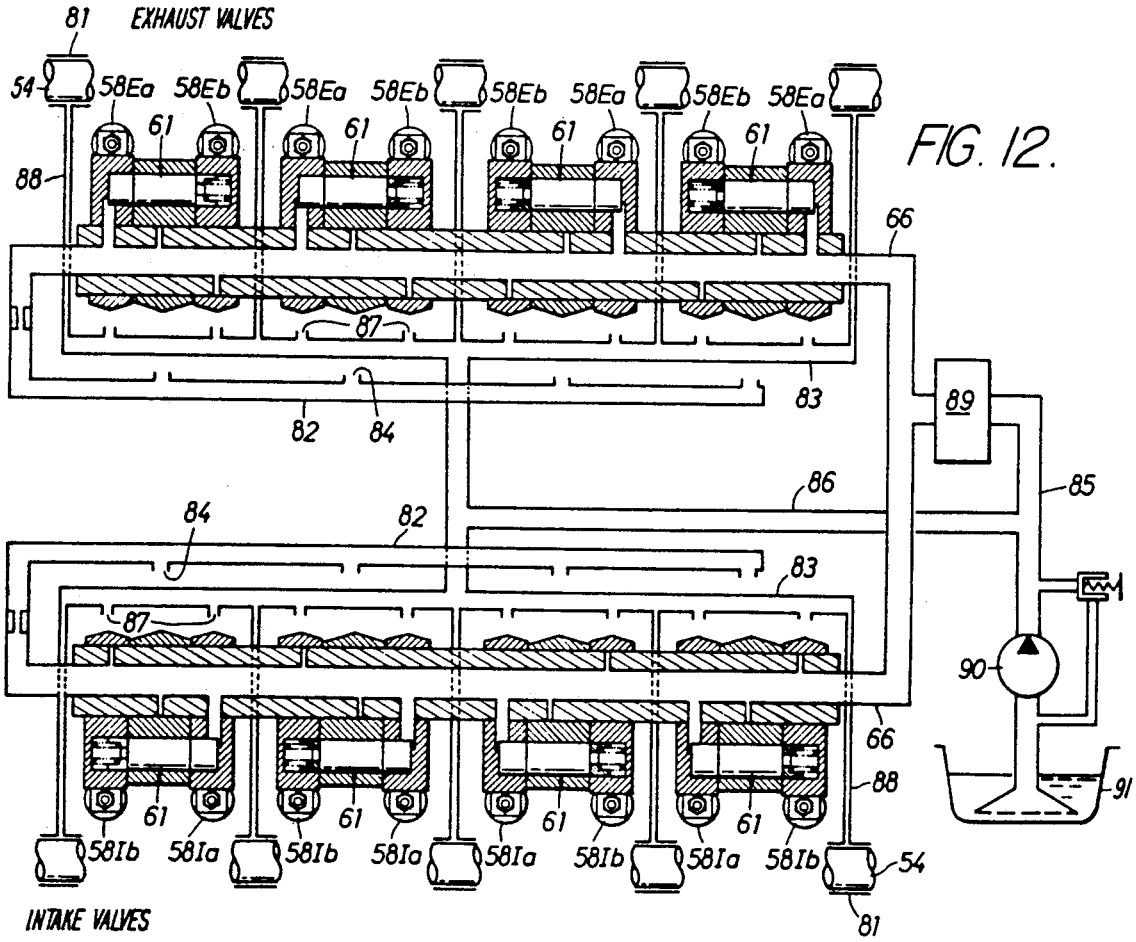
FIG. 12 is a hydraulic circuit diagram of the overall hydraulic system of the valve actuating mechanism.
Figure 13:
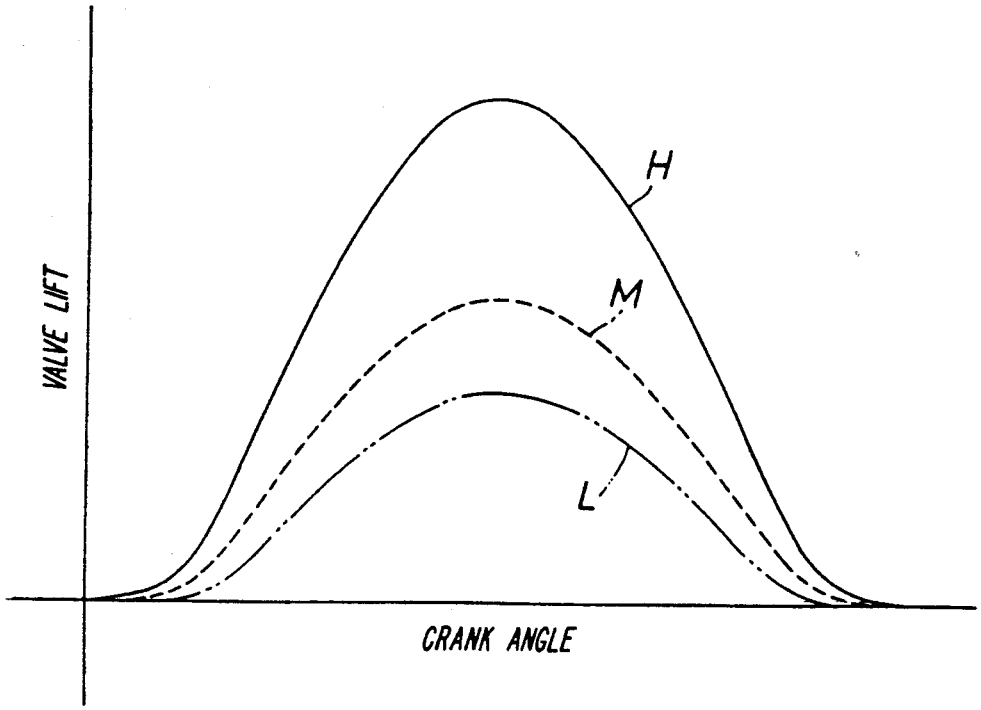
FIG. 13 is a graph showing the valve lift curves of the valve actuating mechanism.

As shown in FIG. 12, a pair of oil supply conduits 82 and 83 are arranged above the camshaft 54 for each cylinder bank so as to lubricate the sliding surfaces defined in the camshaft bearing 81 and between the cam slippers 51*a*, 52*a* and 53*a* formed on the upper surfaces of the rocker arms 51, 52 and 53. As there are two identical hydraulic circuits for the two cylinder banks of the engine, only one half of the entire system is described in the following. Also, as each of the cylinder is provided with an identical structure, only one of them is described wherever appropriate.

A downstream end of the oil supply passage 66 provided in the rocker shaft 50 is connected to the high-speed lubrication oil supply conduit 82 of the aforementioned oil supply conduits. This high-speed lubrication oil supply conduit 82 is provided with oil jet orifices 84 to spew lubrication oil to corresponding parts of the third rocker arms 53. The low-speed lubrication oil supply conduit 83 is connected to a lubrication oil passage 86 which is branched off from an oil gallery 85. The low-speed lubrication oil supply conduit 85 is provided with oil jet orifices 87 to spew lubrication oil to corresponding parts of the first rocker arms 51 and the second rocker arms 52, as well as to the cam bearings 81 via oil passages 88.

An oil pressure control valve 89 is provided between the oil passage 66 provided in the rocker shaft 50 and the oil gallery 85, and is controlled by a control signal supplied from a control unit not shown in the drawings When this oil pressure control valve 89 is closed, no oil pressure is supplied to the oil supply passage 66 and the coupling pins 63 and 68 are urged towards their decoupled states by the return spring 71 so that the rocker arms 51, 52 and 53 may be individually driven by the corresponding cams 55, 56 and 57. In this case, the lubrication oil supplied from an oil pan 91 to the oil gallery 85 by a pump 90 is supplied to the low-speed lubrication oil supply passage 83 via the lubrication oil passage 86 to lubricate the sliding surfaces between the first and the second low-speed cams 55 and 57 and the cam slippers 51*a* and 52*a* of the first and second rocker arms as well as the cam bearings 81.

When the oil pressure control valve 89 is opened, lubrication oil under pressure is supplied from the oil gallery 85 to the oil supply passage 66. When this oil pressure is supplied to the first rocker arm 51, the first and the second coupling pins 63 and 68 are slid into the second guide bore 67 and the third guide bore 69, respectively, against the biasing force of the return spring 71, and the rocker arms 51, 52 and 53 are integrally coupled with each other. The lubrication oil supplied to the oil supply passage 66 not only actuates the coupling control device 61 for each cylinder but also is supplied to the high-speed lubrication oil supply conduit 82 via the downstream end of the oil supply passage 86 to lubricate the sliding surface between the high speed cam 56 and the cam slipper 53*a* of the third rocker arm 53.

According to this coupling control device, for each cylinder, as the oil pressure of the oil supply passage 66 increases, the first coupling pin 63 slides into the second guide bore 67 and the second coupling pin 68 slides into the third guide bore 69 against the spring force of the return spring 71 so as to couple the three rocker arms 51, 52 and 53 with one another. Since the cam profile of the high-speed cam 56 is larger than those of the first and second low-speed cams 55 and 57, the first and second rocker arms 51 and 52 are also driven by the high-speed cam 56 in the center, and the valves 58*a* and 58*b* are both driven according to the crank angle region for opening the valve and the valve lift of the high speed mode as represented by the curve H in FIG. 13.

When the oil pressure of the oil supply passage 66 is low, the first coupling pin 63 and the second coupling pin 68 are located in the first guide bore 67 and the second guide bore 67, respectively, while the stopper pin 70 is located in the third guide bore 69. Under this condition, the rocker arms 51, 52 and 53 can move individually. In this decoupled state, the third rocker arm 53 in the center simply pushes the lifter 60 driven by the high-speed cam 56 and undergoes a lost-motion movement whereas the first rocker arm 51 and the second rocker arm 52 actuate the valves 58*a* and 58*b*, respectively, according to different crank angle regions for opening the valves and valve lifts, driven by the first low-speed cam 55 and the second low-speed cam 57, respectively. In other words, one of the valves 58*a* is actuated according to the curve L of FIG. 13 corresponding to the cam profile of the first low-speed cam 55 so as to have a smallest crank angle range for opening the valve and a smallest valve lift while the other valve 58*b* is actuated according to the curve M of FIG. 13 corresponding to the cam profile of the second low-speed cam 57 so as to have an intermediate crank angle range for opening the valve and an intermediate valve lift.

When the operating condition of the engine changes from a high speed operation to a low speed operation, the oil pressure of the oil supply passage 66 is eliminated. In such a case, if an effective part of the high speed cam 56 is in contact with the cam slipper 53*a* of the third rocker arm 53, since the first and second coupling pins 63 and 68 are subjected to forces which are perpendicular to their longitudinal line, and the frictional forces which the coupling pins 63 and 68 receive from the first and second guide bores 62 and 67 are so great that the first and second coupling pins 63 and 68 may not be able to slide. When the cam slipper 53*a* of the third rocker arm 53 has come to slide over a base circle part of the high speed cam 56, the perpendicular force acting on the first and the second coupling pins 63 and 68 are reduced, and the first and the second coupling pins 63 and 68 can then slide into the first and the second guide bores 62 and 67, respectively.

Since the third rocker arm 53 is provided with a relatively large width or a relatively large longitudinal dimension along the longitudinal line of the rocker shaft 50 to reduce the magnitude of its surface pressure per unit area to compensate for its large valve lift, the sliding resistance of the second coupling pin 68 is greater than those of the other coupling pins. Therefore, the first coupling pin 63 may return to the first guide bore 62 slightly before the third coupling pin 68 depending on inertia and friction conditions. Therefore, the decoupling between the third rocker arm 53 and the first rocker arm 51 may occur before the decoupling between the third rocker arm 53 and the second rocker arm 52. In other words, the possibility of failing to complete a decoupling action during a base circle part of the corresponding cam is higher between the third rocker arm 53 and the second rocker arm 52 than between the third rocker arm 53 and the first rocker arm 51. An occurrence of a decoupling action at an intermediate point of a valve lift means that the cam slipper of one of the rocker arms is thrown against the cam surface by a stroke equal to the difference between the valve lifts effected by the two different cam profiles corresponding to the two rocker arms in question, and an impulsive striking noise may be generated as a result. Therefore, according to the present embodiment, the coupling between the third rocker arm 53 corresponding to the high-speed cam 56 for the large valve lift and the second rocker arm 52 corresponding to the second low-speed cam 57 is accomplished by the second coupling pin 68 which can less readily slide than the first coupling pin 63 so that the impact of the rocker arm upon the cam surface would be minimized even when a decoupling action should occur during a valve lift stroke.

Figure 14:
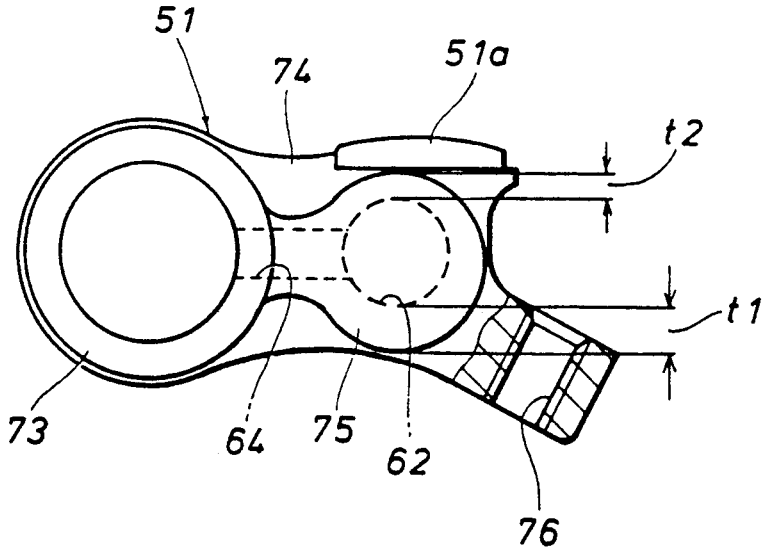
FIG. 14 is a side view of the first rocker arm partly in section.

As shown in FIG. 14, the first rocker arm 51 is provided with a cylindrical bearing portion 73 at a base end of its arm portion 74 for passing the rocker shaft 50 therethrough, and a threaded bore 76 is provided in a free end of the arm portion 74 for engaging a tappet screw therein. An intermediate part of the arm portion 74 is provided with a cylindrical portion 75 for defining the first guide bore 62 therein. The cam slipper 51*a* is provided in the arm portion 74 adjacent to the cylindrical portion 75. The first guide bore 62 is offset from the center of the cylindrical portion 75 towards the cam slipper 51*a* so that the thickness t2 of the cylindrical portion 75 adjacent to the cam slipper 51*a* is substantially smaller than the thickness t1 of the cylindrical portion 75 remote from the cam slipper 51*a*. The second rocker arm 52 is substantially identical to the first rocker arm 51, and its guide bore 69 is likewise offset from the center of its cylindrical portion 77.

In low speed range of the engine, as substantially no actuating oil pressure is applied to the hydraulic chamber 64*a*, and as shown in FIG. 11, the pins 63, 68 and 70 are urged by the return spring 71 into their corresponding guide bores 62, 67 and 69 so that the three rocker arms 51, 52 and 53 can move individually. In high speed range of the engine, oil pressure is supplied to the oil pressure chamber 64*a*, and the first and second coupling pins 63 and 68 are moved into the second and third guide bores 67 and 69, respectively, so that the three rocker arms 51, 52 and 53 move as an integral body.

Since the coupling pins 63, 68 are manufactured so as to have a certain range of tolerance, and a certain play is inevitable between the coupling pins and the corresponding bores. Therefore, when the rocker arms 51, 52 and 53 are actuated by the high speed cam 56, the coupling pins 63 and 68 tend to slant with respect to the guide bores 62, 67 and 69 as illustrated in FIG. 15 in exaggerated form. Therefore, relatively large loads are applied to lower parts of the cylindrical portions 75 and 77 of the first and the second rocker arms 51 and 52. However, since these parts are made thicker than the upper parts of the cylindrical portions 75 and 77, a sufficient rigidity and mechanical strength can be ensured. On the other hand, because the upper parts of the cylindrical portions 75 and 77 receive relatively small forces from the coupling pins 63 and 68, and are reinforced by the cam slippers 51*a* and 52*a*, reducing their thicknesses would not create any problem.

The above described valve actuating system is mounted on a cylinder head 59 similar to the cylinder head 7 illustrated in FIG. 2. According to the third embodiment, each cylinder has two intake valves 58I*a* and 58I*b* and two exhaust valves 58E*a* and 58E*b*. In high speed range, the three rocker arms 51, 52 and 53 are integrally coupled by the coupling pins 63 and 68, and these valves are fully opened by the high speed cam 56. However, in low speed range, the intake valve 58I*a* controlling an intake port 114*b* located closer to the longitudinal center of the cylinder bank is opened over a small crank angle region and its valve lift is small while the other intake valve 58I*b* controlling an intake port 114*a* located more remote from the longitudinal center of the cylinder bank is opened over a relatively large crank angle region and its valve lift is intermediate or relatively large. Further, the exhaust valve 58E*a* controlling an exhaust port 115*a* located more remote from the longitudinal center of the cylinder bank is opened over a small crank angle region and its valve lift is small while the other exhaust valve 58E*b* controlling an exhaust port 115*b* located closer to the longitudinal center of the cylinder bank is opened over a relatively large crank angle region and its valve lift is intermediate or relatively large.

Therefore, according to the third embodiment, now referring to FIG. 16, in a low speed mode where the two intake valves 58I*a* and 58I*b* and the two exhaust valves 58E*a* and 58E*b* are actuated to have different crank angle regions for opening the valves and different valve lifts, respectively, the intake valve 58I*b* and the exhaust valve 58E*b* located diametrically opposed positions of the combustion chamber 113 with respect a spark plug P provided centrally therein are actuated to handle relatively large flow rates.

During the exhaust stroke of the engine, the exhaust valve 58E*b* of a relatively large flow rate located closer to the longitudinal central part of the cylinder bank opens earlier than and closes later than the other exhaust valve 58E*a*. Furthermore, since the exhaust passage 119 communicated with the exhaust valve 58E*b* of a larger flow rate is more linear and involves less resistance than the other, the exhaust flow in the combustion chamber 113 is directed towards the exhaust valve 58E*b* located closer to the longitudinally central part of the cylinder bank as indicated by the arrow E as shown in FIG. 16.

During the intake stroke of the engine, the intake valve 58I*b* of a relatively large flow rate located further away from the longitudinal central part of the cylinder bank opens earlier than and closes later than the other intake valve 58I*a*. Furthermore, since the intake passage 118 communicated with the intake valve 58I*b* of a larger flow rate is curved leftward as seen along the direction of the flow of air/fuel mixture, the mixture flows into the combustion chamber 113 along a substantially tangential direction. Therefore, the intake flow in the combustion chamber 113 is directed as indicated by the arrow I as shown in FIG. 16. This is directed in parallel with the direction indicated by the arrow E, and a swirl effect is promoted. By thus creating a difference in flow rate in diametric direction, it becomes possible to achieve a high volumetric efficiency of the engine, a favorable mixing of air and fuel, and a high scavenging effect.

Figure 17:
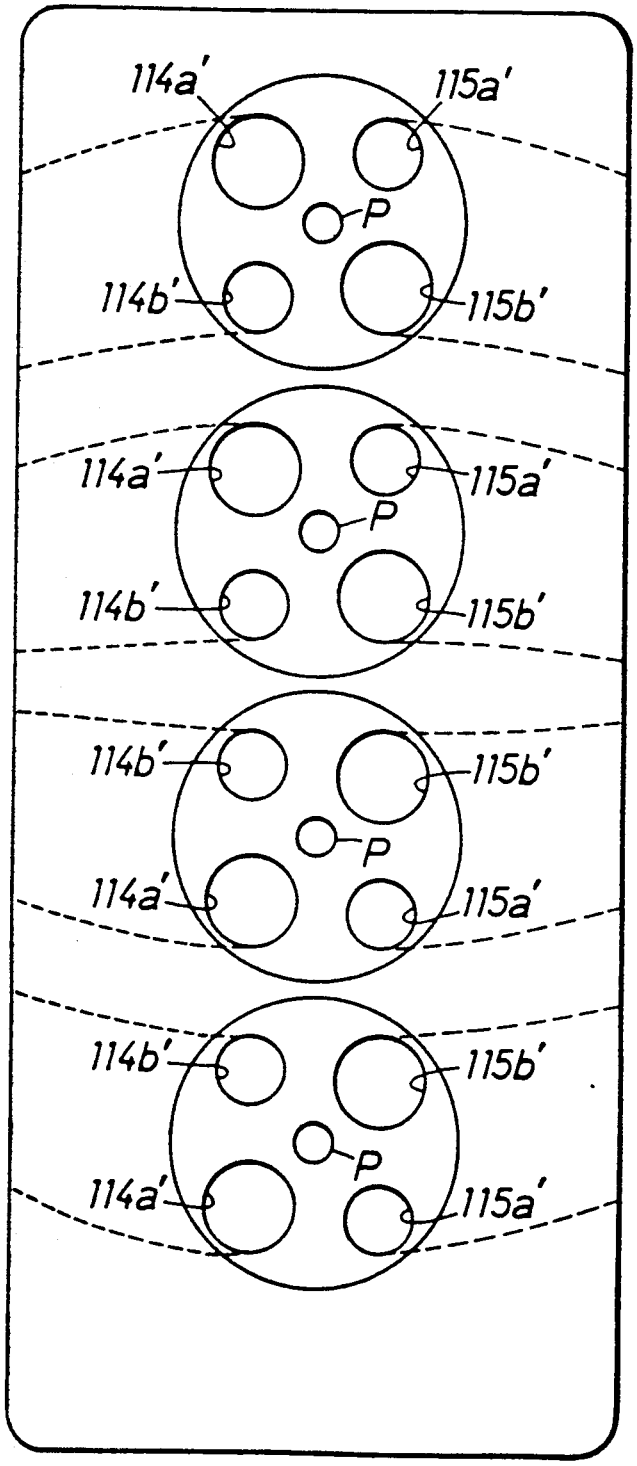
FIG. 17 is a schematic bottom view of another modified embodiment of the cylinder head according to the present invention.

According to the present invention, it is contemplated to enhance the directivity of mixture by controlling the crank angle range of opening the valve and its valve lift, but a similar effect can be achieved by matching the port dimensions of those located on either side of a spark plug P, or, in other words, by making the diameters of the external intake port 114*a*' and the central exhaust port 115*b*' relatively large and making the central intake port 114*b*' and the external exhaust port 115*a*' relatively small as shown in FIG. 17. Here, "external" and "central" are meant as positional relationships along the longitudinal line of the cylinder bank. This embodiment can also produce effects similar to those of the previous embodiment.

Thus, according to the present invention, it is possible to create a significant swirl of mixture in the combustion chamber and improve combustion efficiency, with the added advantage of reducing the dimensions of the intake and exhaust manifolds along the longitudinal direction of the crankshaft. Therefore, a significant advantage can be gained in improving the performance of the engine and reducing its size.

What is claimed is:

1. A cylinder head structure for a multiple cylinder engine, comprising, at least for each of its cylinders located at either longitudinal end of its cylinder bank:

a combustion chamber (13) defined by the cylinder (1) and a piston (2) received therein;

an intake passage (18) communicated with an intake manifold (20) at its one end and with said combustion chamber at its other end; and an exhaust passage (19) communicated with an exhaust manifold (21) at its one end and with said combustion chamber at its other end;

at least one of said intake passage and said exhaust passage being curved toward a longitudinally central part of said cylinder bank as it extends from its other end to its one end, said curved passage being communicated with said combustion chamber at its other end by at least two ports (14*a*, 14*b*, 15*a*, 15*b*) which are controlled by valves (12*a*, 12*b*) and arranged along a longitudinal direction of said cylinder bank, and one of said ports involving a relatively larger flow rate being disposed closer to a longitudinally central part of said cylinder bank than the other port involving a relatively smaller flow rate.

2. A cylinder head structure according to claim 1, wherein said valves are actuated by cams (55, 56, 57) having different cam profiles.

3. A cylinder head structure according to claim 1, wherein said ports (14*a*', 14*b*', 15*a*', 15*b*', 114*a*', 114*b*', 115*a*', 115*b*') have different opening areas.

4. A cylinder head structure for a multiple cylinder engine, comprising, at least for each of its cylinders located at either longitudinal end of its cylinder bank:

a combustion chamber (13) defined by the cylinder (1) and a piston (2) received therein;

an exhaust passage (19) communicated with an exhaust manifold at its one end and with said combustion chamber at its other end by at least two ports (15*a*', 15*b*') which are controlled by exhaust valves and arranged along a longitudinal direction of said cylinder bank, said exhaust passage being curved toward a longitudinally central part of said cylinder bank as it extends from its other end to its one end, and one of said ports involving a relatively larger flow rate being disposed closer to a longitudinally central part of said cylinder bank than the other port involving a relatively smaller flow rate; and an intake passage (18) communicated with an intake manifold at its one end and with said combustion chamber at its other end by at least two ports (14*a*', 14*b*') which are controlled by intake valves and arranged along a longitudinal direction of said cylinder bank, one of said intake ports involving a relatively larger flow rate being disposed closer to a longitudinally central part of said cylinder bank than the other intake port involving a relatively smaller flow rate.

5. A cylinder head structure for a multiple cylinder engine, comprising, at least for each of its cylinders located at either longitudinal end of its cylinder bank:

a combustion chamber defined by the cylinder and a piston received therein;

an exhaust passage communicated with an exhaust manifold at its one end and with said combustion chamber at its other end by at least two ports which are controlled by exhaust valves and arranged along a longitudinal direction of said cylinder bank, said exhaust passage being curved toward a longitudinally central part of said cylinder bank as it extends from its other end to its one end, and one of said ports involving a relatively larger flow rate being disposed closer to a longitudinally central part of said cylinder bank than the other port involving a relatively smaller flow rate; and an intake passage communicated with an intake manifold at its one end and with said combustion chamber at its other end;

said ports of said cylinders being arranged symmetrically with respect to a longitudinally central part of said cylinder bank.

6. A cylinder head structure for a multiple cylinder engine, comprising, at least for each of its cylinders located at longitudinally central and symmetric parts of its cylinder bank:

a combustion chamber defined by the cylinder and a piston received therein;

an exhaust passage communicated with an exhaust manifold at its one end and with said combustion chamber at its other end by at least two ports which are controlled by valves and arranged along a longitudinal direction of said cylinder bank, said exhaust passage being curved toward a longitudinally central part of said cylinder bank as it extends from its other end to its one end, and one of said ports involving a relatively larger flow rate being disposed closer to a longitudinally central part of said cylinder bank than the other port involving a relatively smaller flow rate; and an intake passage communicated with an intake manifold at its one end and with said combustion chamber at its other end;

said ports of said cylinders being arranged symmetrically with respect to a longitudinally central part of said cylinder bank.

7. A cylinder head structure for a multiple cylinder engine, comprising, at least for each of its cylinders located at either longitudinal end of its cylinder bank;

a combustion chamber (13) defined by the cylinder (1) and a piston (2) received therein;

an exhaust passage (19) communicated with an exhaust manifold at its one end and with said combustion chamber at its other end by at least two ports (114*a*', 114*b*') which are controlled by exhaust valves and arranged along a longitudinal direction of said cylinder bank, said exhaust passage being curved toward a longitudinally central part of said cylinder bank as it extends from its other end to its one end, and one of said ports involving a relatively larger flow rate being disposed closer to a longitudinally central part of said cylinder bank than the other port involving a relatively smaller flow rate; and an intake passage (18) communicated with an intake manifold at its one end and with said combustion chamber at its other end by at least two ports (115*a*', 115*b*') which are controlled by intake valves and arranged along a longitudinal direction of said cylinder bank, one of said intake ports involving a relatively smaller flow rate being disposed closer to a longitudinally central part of said cylinder bank than the other intake port involving a relatively larger flow rate.

8. A cylinder head structure according to claim 7, wherein said exhaust and intake valves are controlled by a valve actuating mechanism in such a manner that all the valves are fully opened in high speed range, and one of said intake valves (581*b*) remote from a longitudinally central part of said cylinder bank and one of said exhaust valves (58E*b*) close to a longitudinally central part of said cylinder bank are opened to intermediate extents while the other intake valve (58I*a*) and the other exhaust valve (58E*a*) are opened to small extents in low speed range.

* * * * *